US011713772B2

(12) United States Patent
Luo et al.

(10) Patent No.: US 11,713,772 B2
(45) Date of Patent: Aug. 1, 2023

(54) FAN FRAME WITH IMPROVED HEAT DISSIPATION PERFORMANCE AND HEAT DISSIPATION FAN HAVING THE SAME

(71) Applicant: CHAMP TECH OPTICAL (FOSHAN) CORPORATION, Foshan (CN)

(72) Inventors: Zheng Luo, Foshan (CN); Xiao-Guang Ma, Foshan (CN); Yong-Kang Zhang, Foshan (CN); Yung-Ping Lin, New Taipei (TW)

(73) Assignee: CHAMP TECH OPTICAL (FOSHAN) CORPORATION, Foshan (CN)

( * ) Notice: Subject to any disclaimer, the term of this patent is extended or adjusted under 35 U.S.C. 154(b) by 0 days.

(21) Appl. No.: 17/699,486

(22) Filed: Mar. 21, 2022

(65) Prior Publication Data

US 2022/0341438 A1 Oct. 27, 2022

(30) Foreign Application Priority Data

Apr. 26, 2021 (CN) ..... 202110464676.6

(51) Int. Cl.

| | |
|---|---|
| ***F04D 19/00*** | (2006.01) |
| ***F04D 29/54*** | (2006.01) |
| ***F04D 25/08*** | (2006.01) |
| ***F04D 29/52*** | (2006.01) |
| ***F04D 25/06*** | (2006.01) |

(52) U.S. Cl.

CPC ..... *F04D 29/542* (2013.01); *F04D 19/002* (2013.01); *F04D 25/06* (2013.01); *F04D 25/08* (2013.01); *F04D 29/522* (2013.01)

(58) Field of Classification Search

CPC ..... F04D 19/002; F04D 25/08; F04D 25/082; F04D 29/541; F04D 29/542

See application file for complete search history.

(56) References Cited

U.S. PATENT DOCUMENTS

| | | | | |
|---|---|---|---|---|
| 2002/0094271 | A1* | 7/2002 | Yeuan | F04D 19/002 416/243 |
| 2003/0063987 | A1* | 4/2003 | Horng | F04D 29/646 417/423.14 |
| 2007/0196208 | A1* | 8/2007 | Takemoto | F04D 29/5806 415/220 |
| 2008/0175729 | A1* | 7/2008 | Kato | F04D 29/542 417/353 |

(Continued)

FOREIGN PATENT DOCUMENTS

| | | |
|---|---|---|
| CN | 101025168 B | 10/2012 |
| CN | 209115352 U | 7/2019 |

*Primary Examiner* — Thomas Fink
(74) *Attorney, Agent, or Firm* — ScienBiziP, P.C.

(57) ABSTRACT

A fan frame with an improved heat dissipation performance includes a frame body, a plurality of stationary blades, and a central base. The frame body defines a flow channel, the central base is arranged within the flow channel and divides the flow channel into flowing zones. Each of the flowing zone includes a high-pressure zone and a low-pressure zone. The central base defines first slot, second slot and receiving groove between the first slot and the second slot, the first slot communicates the high-pressure zone and the receiving groove, the second slot communicates the low-pressure zone and the receiving groove.

14 Claims, 4 Drawing Sheets

(56) References Cited

U.S. PATENT DOCUMENTS

| | | | | |
|---|---|---|---|---|
| 2009/0081036 | A1* | 3/2009 | Takeshita | F04D 25/0613 415/208.2 |
| 2018/0100518 | A1* | 4/2018 | Sun | F04D 19/007 |
| 2018/0142704 | A1* | 5/2018 | Sakoda | F04D 29/703 |
| 2019/0063465 | A1* | 2/2019 | Hsieh | F04D 25/0613 |
| 2019/0093662 | A1* | 3/2019 | Inouchi | F04D 29/329 |
| 2019/0093668 | A1* | 3/2019 | Inouchi | F04D 25/0613 |
| 2019/0093669 | A1* | 3/2019 | Inouchi | F04D 19/002 |
| 2019/0145429 | A1* | 5/2019 | Ishida | F04D 29/661 417/354 |
| 2020/0177035 | A1* | 6/2020 | Fukushima | H02K 7/14 |
| 2020/0208653 | A1* | 7/2020 | Tokuno | H02K 7/14 |

* cited by examiner

FAN FRAME WITH IMPROVED HEAT DISSIPATION PERFORMANCE AND HEAT DISSIPATION FAN HAVING THE SAME

FIELD

The subject matter herein generally relates to heat dissipation, and more particularly, to a fan frame with improved heat dissipation performance and a heat dissipation fan having the fan frame.

BACKGROUND

Electronic devices, such as servers, include electronic components and heat dissipation fans to dissipate heat generated by the electronic components. In use, the heat dissipation fan drives cool air in the ambient environment to replace hot air around the electronic components. However, the hot air may flow in irregular ways when passing through a fan frame of the heat dissipation fan, resulting in a poor heat dissipation performance.

BRIEF DESCRIPTION OF THE DRAWINGS

Implementations of the present technology will now be described, by way of example only, with reference to the attached figures.

DETAILED DESCRIPTION

Figure 1:
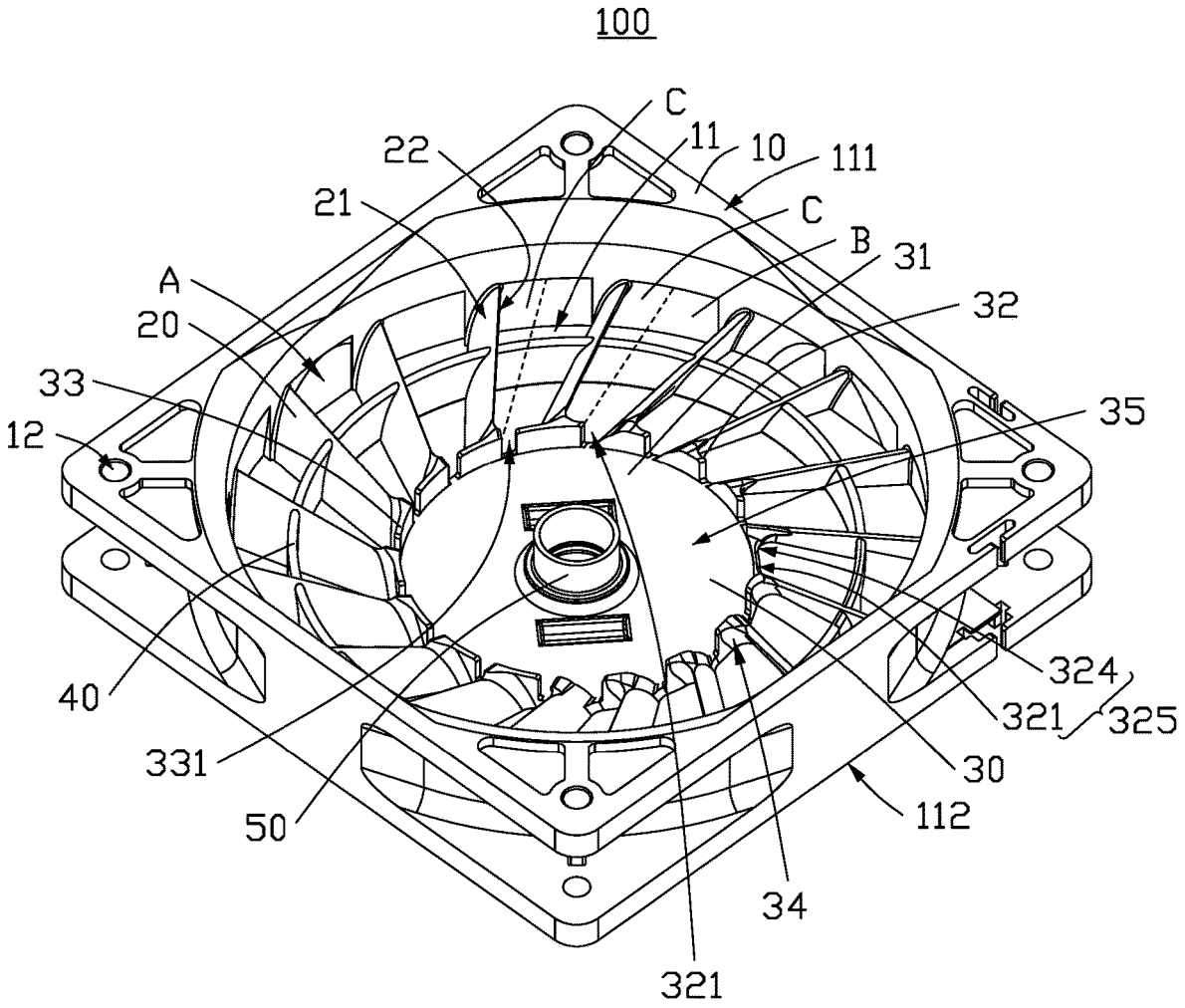
FIG. 1 is a diagrammatic view of a heat dissipation fan according to an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to better illustrate details and features of the present disclosure.

The disclosure is illustrated by way of example and not by way of limitation in the figures of the accompanying drawings, in which like references indicate similar elements. It should be noted that references to "an" or "one" embodiment in this disclosure are not necessarily to the same embodiment, and such references mean "at least one."

The term "comprising," when utilized, means "including, but not necessarily limited to"; it specifically indicates open-ended inclusion or membership in the so-described combination, group, series, and the like.

Figure 2:
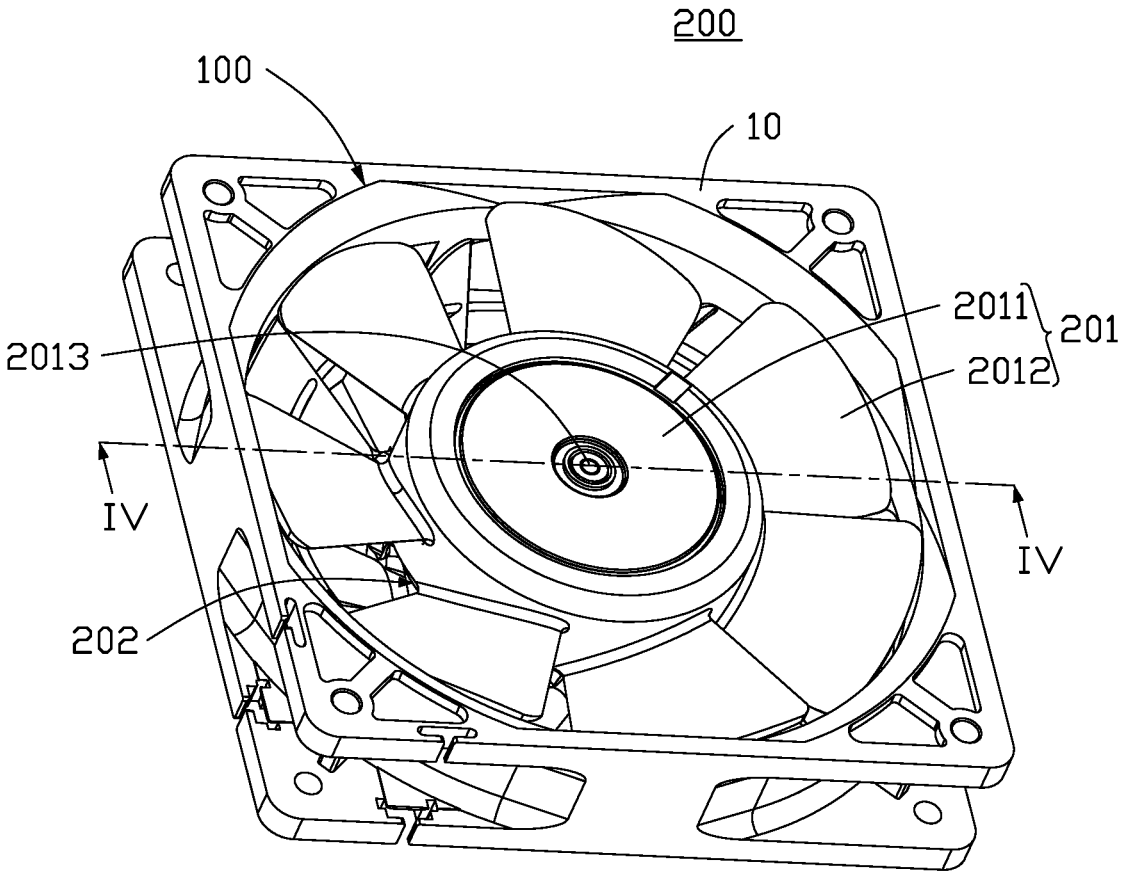
FIG. 2 is similar to FIG. 1, but showing the heat dissipation fan from another angle.

Referring to FIGS. 1 and 2, an embodiment of a fan frame 100 is provided. The fan frame 100 includes a hollow frame body 10, a plurality of stationary blades 20, and a central base 30. The frame body 10 defines a flow channel 11 allowing a fluid to pass through. The flow channel 11 includes an inlet 111 and an outlet 112 opposite to the inlet 111. The central base 30 is arranged within the flow channel 11. The stationary blades 20 connects between the central base 30 and the frame body 10. The stationary blades 20 is disposed obliquely with respect to a direction from the inlet 111 to the outlet 112. In this embodiment, the fluid is air, in other embodiments, the fluid can be other heat dissipation medium such as water, ethanol, etc.

Referring to FIGS. 1 and 2, each of the stationary blades 20 includes a windward surface 21 and a leeward surface 22 opposites to the windward surface 21. The windward surface 21 faces the inlet 111, and the leeward surface 22 y faces the outlet 112. The stationary blades 20 divide the flow channel 11 into a plurality of flow zones A. Each flow zone A includes a first zone B and a second zone C, the first zone B is close to the windward surface 21, and the second zone C is close to the leeward surface 22.

Referring to FIGS. 1 and 2, the central base 30 includes a bottom plate 31, a first side plate 32, and a second side plate 33. The first side plate 32 connects to the second side plate 33 to form an annular wall 34, and the annular wall 34 surrounds an edge of the bottom plates 31 to form a receiving groove 35. The receiving groove 35 accommodates a driving motor 202 (referring to FIGS. 3 and 4) that generates heat therein.

Referring to FIGS. 1 and 2, the first side plate 32 defines a plurality of first slots 321, and the second side plate 33 defines a plurality of second slots 331. Each of the first slots 321 communicates with the first zone B and the receiving groove 35 for guiding air to flow from the first zone B to the receiving groove 35. Each of the second slots 331 communicates with the second zone C and the receiving groove 35 for guiding air to flow from the receiving groove 35 to the second zone C.

Referring to FIGS. 1 and 2, when air passes through the flow channel 11, the stationary blades 20 compress the air to generates a high-pressure zone (not shown) near the windward surface 21 and a low-pressure zone (not shown) near the leeward surface 22. The air in the high-pressure region is further introduced into the receiving groove 35 through the first slots 321. Then, the air in the receiving groove 35, which carries the heat generated by the driving motor 202, is introduced into the low-pressure region through the second slots 331. As such, the heat generated by the driving motor 202 is dissipated.

The fan frame 100 provided by the present application is provided with a plurality of first slots 321 on the first side plate 32, and a plurality of second slots 331 is provided on the second side plate 33, so that air flows into the receiving groove 35 through the first slot 321 and out of the receiving groove through the second slot 331, thereby avoiding disorder of airflow and improving heat dissipation efficiency. Meanwhile, regulated airflow also helps to reduce noises.

Referring to FIGS. 1 and 2, in this embodiment, the stationary blades 20 are arranged evenly around the annular wall 34, and the stationary blades 20 are inclined with respect to a direction from the inlet 111 to the outlet 112, so that the windward surface 21 faces the airflow, and the leeward surface 22 are opposite to airflow.

Referring to FIGS. 1 and 2, in this embodiment, one of the first slots 321 or one of the second slots 331 is disposed between every two adjacent stationary blades 20, and the number of the first slots 321 is the same as the number of the second slots 331.

Referring to FIGS. 1 and 2, in this embodiment, the windward surface 21 is partially exposed to the first slots 321, so that air in the first zone B can enter the receiving space 35 without obstacles. The leeward surface 22 is spaced apart from the second slots 331, thereby prolonging a flow path of air from the receiving groove 35 into the second zone C and improving the heat dissipation efficiency.

Referring to FIGS. 1 and 2, in this embodiment, the first side plate 32 is provided with a third slot 324 that passing through the opposite sides of the first side plate 32. The third slot 324 connects the first zone B and the receiving groove 35. The third slot 324 further connects the first slot 321 to form a wiring slot 325. Wires of the driving motor 202 can be disposed in the wiring slot 325.

Referring to FIGS. 1 and 2, in this embodiment, the fan frame 100 also includes a fixing ring 40, which is sleeved outside the central base 30. Each stationary blade 20 passes through the fixing ring 40 to connect the stationary blades 20 as a whole.

Referring to FIGS. 1 and 2, in this embodiment, the fan frame 100 also includes a fixing seat 50, which is arranged in the center of the bottom plate 31. The fixing seat 50 is used to fix the driving motor 202.

Referring to FIGS. 1 and 2, in this embodiment, the frame body 10 defines a plurality of fixing holes 12 penetrating two opposite side of the frame body 10. The fixing holes 12 is used for fixing the frame body 10 to a workpiece, such as a casing of desktop computer.

Figure 3:
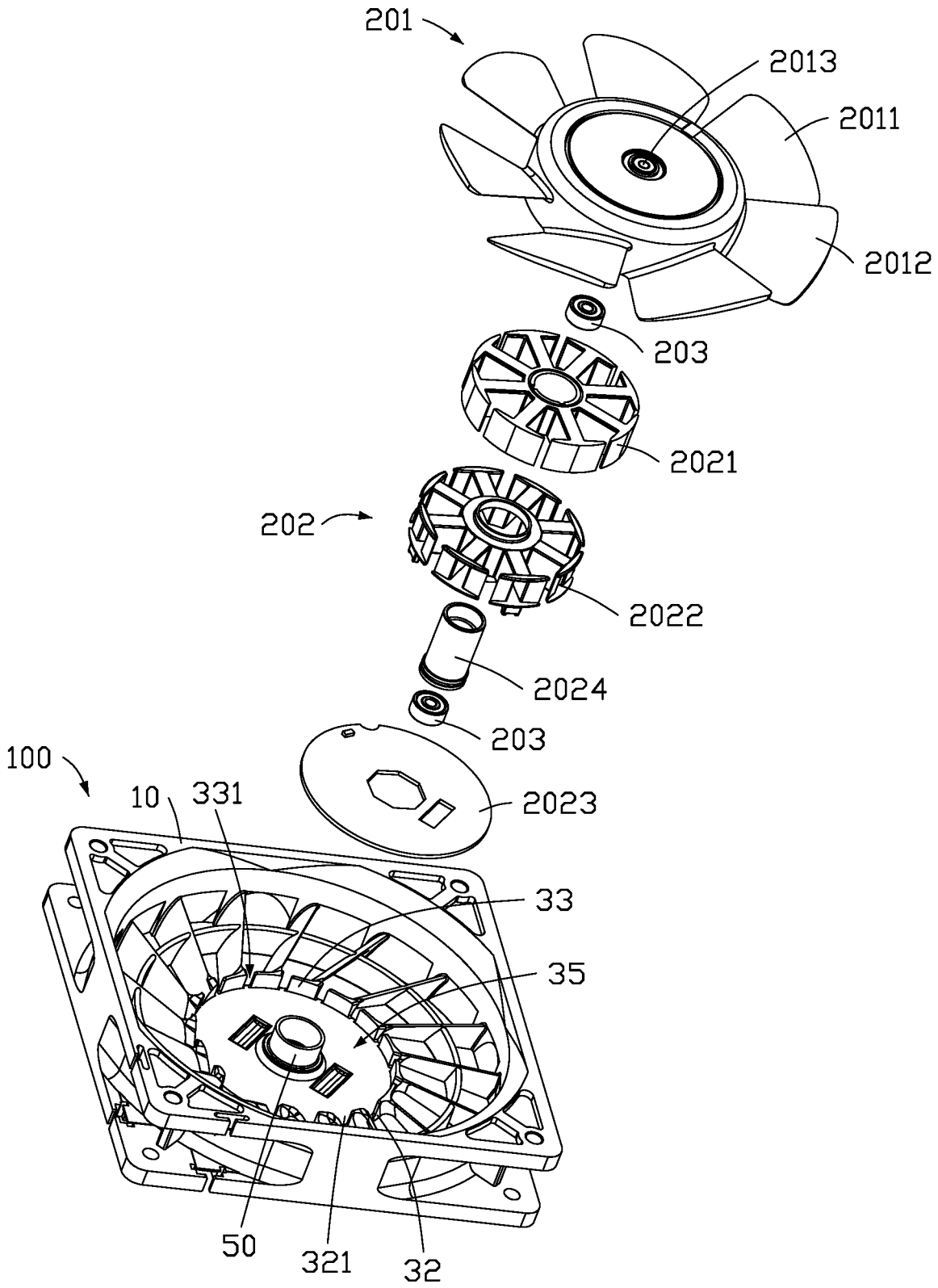
FIG. 3 is an exploded view of the heat dissipation fan of FIG. 1.
Figure 4:
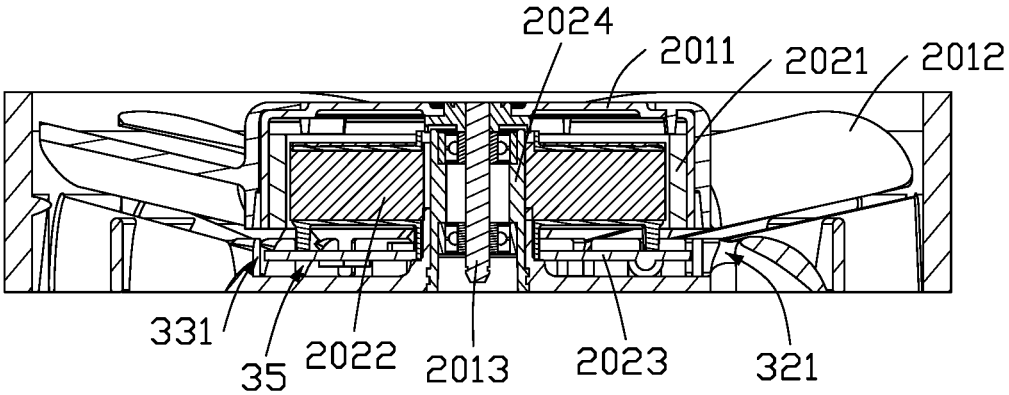
FIG. 4 is a cross-sectional view along IV-IV of FIG. 2.

Referring FIGS. 2, 3 and 4, the embodiment of this application provides a heat dissipation fan 200. The heat dissipation fan 200 includes the fan frame 100, a rotating disc 201, the driving motor 202, and a bearing 203. The driving motor 202 is arranged within the receiving groove 35. The rotating disc 201 connects to the driving motor 202. The driving motor 202 is used to drive the rotating disc 201 to rotate, so that the rotating disc 201 drives air to go through the flow channel 11.

Referring FIGS. 2, 3 and 4, in this embodiment, the rotating disc 201 includes a disc body 2011, a plurality of rotating blades 2012, and a rotating shaft 2013. The rotating blades 2012 are arranged outside the disc body 2011. The rotating shaft 2013 is arranged on the center of the disc body 2011 and connected to the driving motor 202 through the bearing 203.

Referring FIGS. 2, 3 and 4, in this embodiment, the driving motor 202 includes a rotor 2021, a stator 2022, a circuit board 2023, and a shaft sleeve 2024. The rotor 2021 is arranged in the disc body 2011, the stator 2022 and the circuit board 2023 are arranged in the receiving groove 35. The rotor 2021 and the stator 2022 are connected through the shaft sleeve 2024, the shaft sleeve 2024 is connected to the bottom plate 31 through the shaft sleeve fixing seat 50, and the rotating shaft 2013 is arranged inside the shaft sleeve 2024 through the bearing 203.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A fan frame comprising:
a frame body;
a plurality of stationary blades; and
a central base;
wherein the frame body defines a flow channel, the flow channel comprises an inlet and an outlet opposite to the inlet, the central base is arranged within the flow channel, each of the plurality of stationary blades connects between the central base and the frame body,
wherein each of the plurality of stationary blades comprises a first end portion connecting the central base and a second end portion connecting the frame body, each of the plurality of stationary blades further comprises a windward surface and a leeward surface opposite to the windward surface, the windward surface faces the inlet, the leeward surface faces the outlet;
wherein the plurality of stationary blades divides the flow channel into a plurality of flowing zones, each of the plurality of flowing zones comprises a first zone near the windward surface and a second zone opposites the first zone and near the leeward surface;
wherein the central base comprises a bottom plate, a plurality of first side plates, and a plurality of second side plates, each of the plurality of first side plates and the plurality of second side plates is arc-shaped, the plurality of first side plates and the plurality of second side plates are formed on the bottom plate, the first end portion of each of the plurality of stationary blades connects to one of the plurality of first side plates or one of the plurality of second side plates; the plurality of first side plates, the plurality of second side plates, and the bottom plate cooperatively form a receiving space; and
wherein adjacent ones of the plurality of first side plates defines a first slot communicating with the first zone and the receiving space, adjacent ones of the plurality of second plates defines a second slot communicating with the receiving space and the second zone, the first end portion of the windward surface connecting the plurality of first side plates directly exposes to the corresponding first slot, thereby allowing air in the first zone to enter the receiving space without obstacles.

2. The fan frame of claim 1, wherein the first slot or the second slot is arranged between adjacent ones of the plurality of stationary blades.

3. The fan frame of claim 1, wherein the leeward surface is spaced apart from the second slot.

4. The fan frame of claim 1, wherein adjacent one of the plurality of first side plates further defines a third slot communicating with the second zone and the receiving space, and the third slot communicating with the first slot.

5. The fan frame of claim 1, wherein the frame body defines a plurality of fixing holes, and the plurality of fixing holes penetrates two opposite sides of the frame body.

6. The fan frame of claim 1, wherein the fan frame further comprises a fixing ring, the fixing ring surrounds the central base, and each of the stationary blades goes through the fixing ring.

7. A heat dissipation fan comprising:
a driving motor;
a rotating disc connects to the driving motor;
a frame body;
a plurality of stationary blades; and
a central base;
wherein the frame body defines a flow channel, the flow channel comprises an inlet and an outlet opposite to the inlet, the central base is arranged within the flow channel, each of the plurality of stationary blades connects between the central base and the frame body,
wherein each of the plurality of stationary blades comprises a first end portion connecting the central base and a second end portion connecting the frame body, each of the plurality of stationary blades further comprises a windward surface and a leeward surface opposite to the windward surface, the windward surface faces the inlet, the leeward surface faces the outlet;

wherein the plurality of stationary blades divides the flow channel into a plurality of flowing zones, each of the plurality of flowing zones comprises a first zone near the windward surface and a second zone opposites the first zone and near the leeward surface;

wherein the central base comprises a bottom plate, a plurality of first side plates, and a plurality of second side plates, each of the plurality of first side plates and the plurality of second side plates is arc-shaped, the plurality of first side plates and the plurality of second side plates are formed on the bottom plate, the first end portion of each of the plurality of stationary blades connects to one of the plurality of first side plates or one of the plurality of second side plates; the plurality of first side plates, the plurality of second side plates, and the bottom plate cooperatively form a receiving space; and wherein adjacent ones of the plurality of first side plates defines a first slot communicating with the first zone and the receiving space, adjacent ones of the plurality of second plates defines a second slot communicating with the receiving space and the second zone, the first end portion of the windward surface connecting the plurality of first side plates directly exposes to the corresponding first slot, thereby allowing air in the first zone to enter the receiving space without obstacles.

8. The heat dissipation fan of claim 7, wherein the rotating disc comprises a disc body, a plurality of rotating blades, and a rotating shaft, the plurality of rotating blades is arranged outside the disc body, the rotating shaft is arranged on a center of the disc body and connected to the driving motor.

9. The heat dissipation fan of claim 7, wherein the driving motor comprising:

a rotor;

a stator;

a circuit board; and a shaft sleeve, wherein the frame body further comprises a fixing seat, the fixing seat is arranged in a center of the bottom plate, the rotor is arranged on the disc body, the circuit board is arranged within the receiving space, the stator is disposed above the circuit board, the rotor and the stator are connected through the shaft sleeve, the shaft sleeve connects to the fixing seat, the rotating shaft is rotatably arranged inside the shaft sleeve.

10. The heat dissipation fan of claim 7, wherein the first slot or the second slot is arranged between adjacent ones of the plurality of stationary blades.

11. The heat dissipation fan of claim 7, wherein the leeward surface is spaced apart from the second slot.

12. The heat dissipation fan of claim 7, wherein adjacent one of the plurality of first side plates further defines a third slot communicating with the second zone and the receiving space, and the third slot communicating with the first slot.

13. The heat dissipation fan of claim 7, wherein the frame body defines a plurality of fixing holes, and the plurality of fixing holes penetrates two opposite sides of the frame body.

14. The heat dissipation fan of claim 7, wherein the fan frame further comprises a fixing ring, the fixing ring is arranged around the central base, each of the stationary blades goes through the fixing ring.

* * * * *